US012478164B2

(12) United States Patent
Yang et al.

(10) Patent No.: US 12,478,164 B2
(45) Date of Patent: Nov. 25, 2025

(54) RETRACTABLE PRESS MAKEUP PEN

(71) Applicant: SHYA HSIN PACKAGING INDUSTRY (CHINA) CO., LTD., Kunshan (CN)

(72) Inventors: Haiying Yang, Kunshan (CN); Cuihong Yang, Kunshan (CN); Changmai Zhang, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 0 days.

(21) Appl. No.: 18/806,704

(22) Filed: Aug. 16, 2024

(65) Prior Publication Data

US 2025/0248502 A1 Aug. 7, 2025

(30) Foreign Application Priority Data

Feb. 1, 2024 (CN) ..... 202410146079.2

(51) Int. Cl.
*A45D 34/04* (2006.01)
*A45D 40/20* (2006.01)

(52) U.S. Cl.
CPC ..... *A45D 34/04* (2013.01); *A45D 40/205* (2013.01); *A45D 2040/207* (2013.01); *A45D 2040/208* (2013.01)

(58) Field of Classification Search
CPC ..... A45D 40/205; A45D 2040/207; A45D 2040/208
USPC ..... 401/179
See application file for complete search history.

(56) References Cited

U.S. PATENT DOCUMENTS

| | | | | |
|---|---|---|---|---|
| 6,702,158 | B2 * | 3/2004 | Kageyama | A45D 34/042 222/386 |
| 10,532,376 | B2 * | 1/2020 | Zhang | B05C 17/0133 |
| 11,980,276 | B2 * | 5/2024 | Kuga | A45D 40/205 |
| 12,070,116 | B1 * | 8/2024 | Lin | A45D 40/06 |

FOREIGN PATENT DOCUMENTS

| | | | |
|---|---|---|---|
| CN | 106798391 | A | 6/2017 |
| CN | 209421237 | U | 9/2019 |
| CN | 115590292 | A | 1/2023 |
| CN | 219645243 | U | 9/2023 |

(Continued)

*Primary Examiner* — Jennifer C Chiang
(74) *Attorney, Agent, or Firm* — Bayramoglu Law Offices LLC

(57) ABSTRACT

A retractable press makeup pen includes a nib assembly, a body assembly, a discharge assembly, and a drive assembly, where the nib assembly includes a sleeve; the body assembly includes a barrel and a coupling member rotatably provided in the barrel; the sleeve is fixedly provided in the barrel; the drive assembly is provided in the coupling member; the discharge assembly is provided in the sleeve; the discharge assembly is connected to the drive assembly; the coupling member in rotation can drive the discharge assembly to move along an axial direction of the sleeve; and the drive assembly can drive the discharge assembly to move along the axial direction of the sleeve. The drive assembly is provided in the makeup pen. The drive assembly includes a button. The button is provided on a tail portion of the makeup pen. Pressing the button with a single hand can realize unidirectional discharge.

11 Claims, 19 Drawing Sheets

(56) References Cited

FOREIGN PATENT DOCUMENTS

| | | | | |
|---|---|---|---|---|
| CN | 222054854 | U | | 11/2024 |
| JP | 7325917 | B2 | * | 8/2023 |
| KR | 101733569 | B1 | | 5/2017 |

* cited by examiner

RETRACTABLE PRESS MAKEUP PEN

CROSS-REFERENCE TO THE RELATED APPLICATIONS

This application is based upon and claims priority to Chinese Patent Application No. 202410146079.2, filed on Feb. 1, 2024, the entire contents of which are incorporated herein by reference.

TECHNICAL FIELD

The present disclosure relates to a cosmetic packaging technology, and in particular to a retractable press makeup pen.

BACKGROUND

Most existing cosmetics such as lipsticks, lip glosses, and eyeliners are discharged in a rotating manner. In use, a base or a rotating portion of the cosmetic container is rotated, thereby driving the cosmetic to extend out of the container. Makeup pens for these cosmetics are operated through the use of two hands, and thus are inconvenient to use.

SUMMARY

The present disclosure provides a retractable press makeup pen, to overcome the above defects. A drive assembly is provided in the makeup pen. The drive assembly includes a button. The button is provided on a tail portion of the makeup pen. Pressing the button with a single hand can realize unidirectional discharge. The present disclosure is used conveniently.

To solve the technical problems, the present disclosure employs the following technical solutions:

A retractable press makeup pen includes a nib assembly, a body assembly, a discharge assembly, and a drive assembly, where the nib assembly includes a sleeve; the body assembly includes a barrel and a coupling member rotatably provided in the barrel; the sleeve is fixedly provided in the barrel; the drive assembly is provided in the coupling member; the discharge assembly is provided in the sleeve; the discharge assembly is connected to the drive assembly; the coupling member in rotation can drive the discharge assembly to move into the sleeve; and the drive assembly can drive the discharge assembly to move out of the sleeve.

Optionally, the coupling member is axially fixed and circumferentially movable in the barrel; and the coupling member in rotation can drive the drive assembly to rotate synchronously, such that the drive assembly drives the discharge assembly to move into the sleeve.

Optionally, the coupling member is unidirectionally rotatable in the barrel.

Optionally, a sawtooth is provided on an inner sidewall of the barrel; a first oblique plane and a first straight plane are provided on the sawtooth; an elastic tooth is provided on the coupling member; a second oblique plane and a second straight plane are provided on the elastic tooth; the first oblique plane can slide on the second oblique plane; and the first straight plane is retained at the second straight plane.

Optionally, a mounting groove is formed in the coupling member; the elastic tooth is provided in the mounting groove; the elastic tooth includes a first end fixedly connected to the coupling member, and a second end being a free end; the second straight plane is located at the second end of the elastic tooth; and the second oblique plane is located on an outer surface of the elastic tooth.

Optionally, the discharge assembly includes a material loading cylinder and a threaded rod fixedly connected to the material loading cylinder; an external thread is provided on an outer sidewall of the threaded rod; the threaded rod is threadedly connected to the drive assembly; and the drive assembly is fixedly provided in the coupling member.

Optionally, the drive assembly includes a button, a ratchet seat, and a rotating member; the ratchet seat is fixedly provided in the coupling member; the button and the rotating member are provided in the ratchet seat; the ratchet seat in rotation can drive the rotating member to rotate synchronously; the threaded rod is threadedly connected to the rotating member; and the button can drive the rotating member to rotate.

Optionally, the material loading cylinder and the threaded rod are an integrally formed member; and alternatively, the material loading cylinder and the threaded rod are split structures, and the threaded rod is clamped and fixed on the material loading cylinder.

Optionally, the body assembly further includes a guiding member; the guiding member is fixedly provided in the barrel; an inner sidewall of the guiding member is provided with a ridge; the threaded rod is provided with a guiding groove along an axial direction; and the ridge is clamped into the guiding groove.

Optionally, the guiding member is directly formed in the barrel; and alternatively, the barrel and the guiding member are split structures, and the guiding member is clamped into the barrel.

Optionally, the drive assembly further includes a ratchet, a ratchet wheel, and an elastic member; the ratchet is fixedly provided in the button; the ratchet and the ratchet wheel are movably provided in the ratchet seat; the ratchet is engaged with the ratchet wheel; the rotating member is sleeved on the threaded rod and threadedly connected to the threaded rod; the rotating member is rotatably provided in the coupling member; the rotating member abuts against the coupling member; the elastic member is provided between the rotating member and the ratchet wheel; the ratchet can drive the ratchet wheel to rotate; and the ratchet wheel can drive the rotating member to rotate, such that the rotating member drives the threaded rod to move away from the button.

Optionally, first latches are provided on the ratchet; second latches and first pawls are provided on the ratchet wheel; second pawls are provided on the rotating member; an internal thread is provided on an inner peripheral wall of the rotating member; the first latch is engaged with the second latch; a gap is formed between two adjacent first pawls; and the second pawls are inserted into the gaps to realize synchronous rotation of the rotating member and the ratchet wheel.

The present disclosure has the following beneficial effects:

(1) According to the present disclosure, the nib assembly includes a sleeve and a cap, the discharge assembly includes a material loading cylinder and a threaded rod, and the body assembly includes a barrel and a coupling member. Since the loading barrel is located at the front end of the sleeve before filling, a cosmetic material is filled to the assembled makeup pen conveniently from the front end of the makeup pen. After the filling, by rotating the coupling member, the drive assembly is driven to rotate synchronously. With threaded connection between the drive assembly and the threaded rod, the threaded rod retracts into the barrel, namely the cosmetic material retracts into the sleeve. Therefore, the operation is very convenient.

(2) The drive assembly can be operated by a single hand to realize discharge of the makeup pen, so the present disclosure is used more conveniently, and can effectively control a discharge amount. With the coupling member, the present disclosure not only can facilitate the filling of the cosmetic material to simplify a filling process, but also can retract the excessive material into the sleeve in use to reduce pollution and waste of the material due to a misoperation. The present disclosure controls unidirectional discharge and unidirectional retraction of the cosmetic material with two systems, thereby meeting use requirements of consumers on accurate discharge and rapid retraction.

Figure 1:
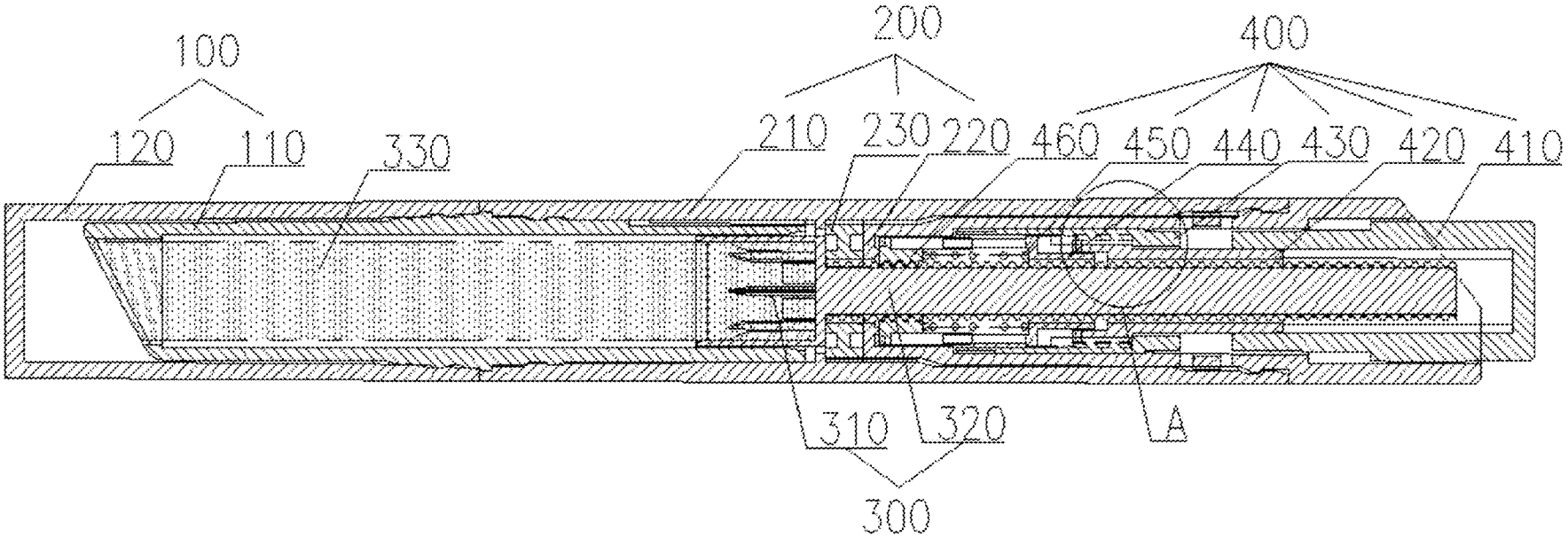
FIG. 1 is a first schematic structural view of a makeup pen according to Embodiment 1 of the present disclosure.

In the figures: 100—nib assembly, 110—sleeve, and 120—cap;

200—body assembly, 210—barrel, 211—sawtooth, 212—first oblique plane, 213—first straight plane, 220—coupling member, 221—elastic tooth, 222—second oblique plane, 223—second straight plane, 230—guiding member, and 231—ridge;

300—discharge assembly, 310—material loading cylinder, 320—threaded rod, 321—external thread, 322—guiding groove, and 330—cosmetic material; and

400—drive assembly, 410—button, 420—ratchet, 421—first latch, 430—ratchet seat, 440—ratchet wheel, 441—second latch, 442—first pawl, 450—elastic member, 460—rotating member, 461—second pawl, and 462—internal thread.

DETAILED DESCRIPTION OF THE EMBODIMENTS

The following describes the technical solutions in the embodiments of the present disclosure clearly and completely with reference to the embodiments of the present disclosure. Apparently, the embodiments described are merely some rather than all of the embodiments of the present disclosure. All other embodiments obtained by a person of ordinary skill in the art based on the embodiments of the present disclosure without creative efforts shall fall within the protection scope of the present disclosure.

It should be noted that the terms "first", "second" and so on in the description and claims of the present disclosure and in the above accompanying drawings are intended to distinguish similar objects but do not necessarily indicate a specific order or sequence. It should be understood that the objects used in such a way may be exchanged under proper conditions to make it possible to implement the described implementations of this application in sequences except those illustrated or described herein. Moreover, the terms "include", "have" and their variants mean to cover a non-exclusive inclusion. For example, a process, method, system, product or device that includes a list of steps or units is not necessarily limited to those steps or units which are clearly listed. Instead, they may include other steps or units which are not expressly listed or inherent to such a process, method, product, or device.

For ease of description, spatially relative terms, such as "above", "on the upper side of", "on the upper surface of" and "on", can be used to describe the spatial positional relationship between components or features shown in the figure. It should be understood that the spatially relative terms are intended to encompass different orientations of the components in use or operation in addition to those shown in the figure. For example, if a component in the figure is inverted, it is described as a component "above other component or structure" or "on other component or structure". Therefore, the component will be positioned as "below other component or structure" or "under other component or structure". Therefore, the exemplary term "above" may include both orientations "above" and "below". The component may also be positioned in other different ways (rotated by 90 degrees or in other orientations), but the relative description of the space should be explained accordingly.

Embodiment 1: As shown in FIGS. 1-21, a retractable press makeup pen includes nib assembly 100, body assembly 200, discharge assembly 300, and drive assembly 400. The nib assembly 100 includes sleeve 110. The body assembly 200 includes barrel 210 and coupling member 220 rotatably provided in the barrel 210. The sleeve 110 is fixedly provided in the barrel 210. The drive assembly 400 is provided in the coupling member 220. The discharge assembly 300 is provided in the sleeve 110. The discharge assembly 300 is connected to the drive assembly 400. The coupling member 220 in rotation can drive the discharge assembly 300 to move into the sleeve 110. The drive assembly 400 can drive the discharge assembly 300 to move out of the sleeve 110.

Optionally, the nib assembly 100 further includes cap 120. The cap 120 is pluggably sleeved on the sleeve 110. Cosmetic material 330 is stored in the discharge assembly 300. The cosmetic material 330 may be a lipstick, an eye shadow, a lip gloss, a lip cream, an eyeliner cream, a sunscreen stick, a body balm or a deodorant stick. The coupling member 220 is configured to drive the discharge assembly 300 to move along an axial direction of the sleeve, such that the cosmetic material 330 retracts into the sleeve 110. The drive assembly 400 is configured to drive the discharge assembly 300 to move along the axial direction of the sleeve 110, such that the cosmetic material 330 extends out of the sleeve 110 for use. The discharge assembly 300 under an action of the coupling member 220 and the discharge assembly 300 under an action of the drive assembly 400 move along the axial direction of the sleeve 110, with opposite moving directions.

Figure 2:
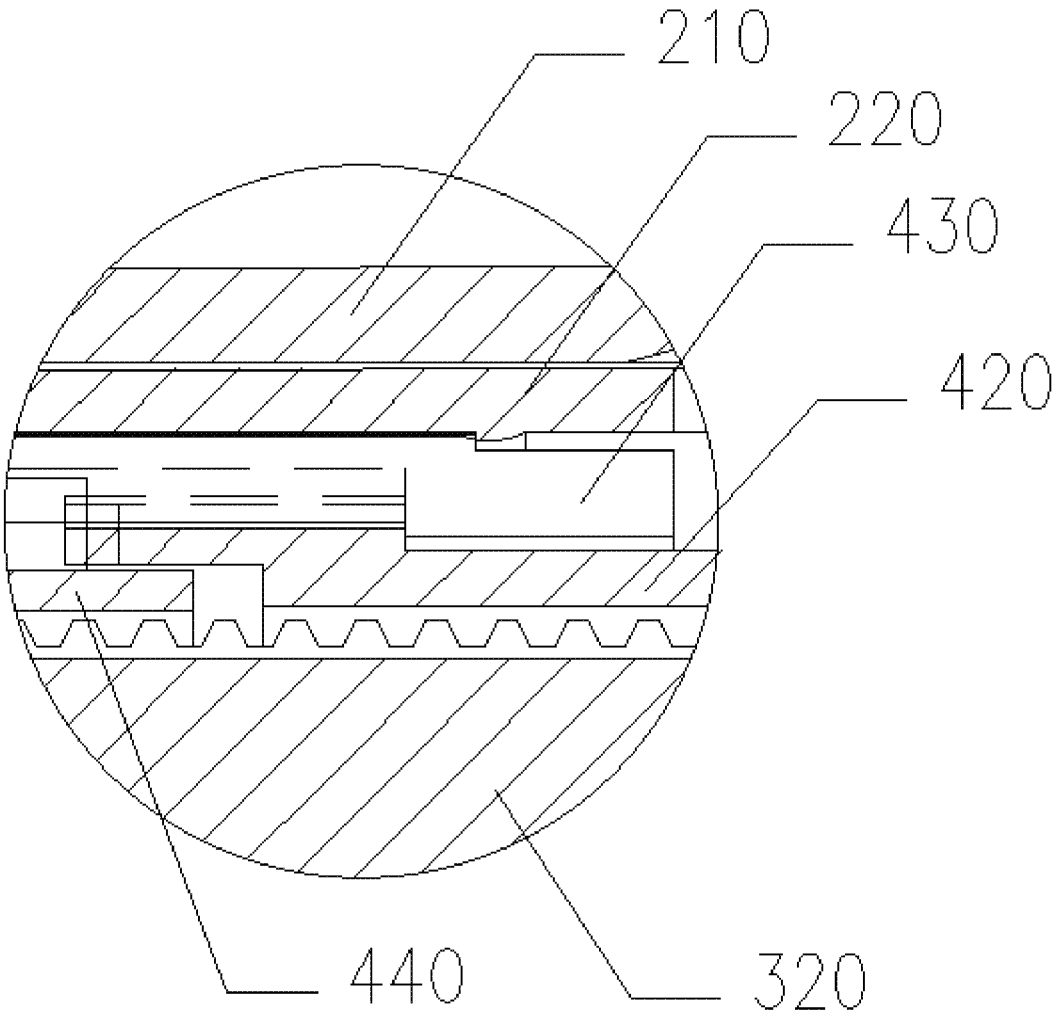
FIG. 2 is an enlarged view of A in FIG. 1.
Figure 3:
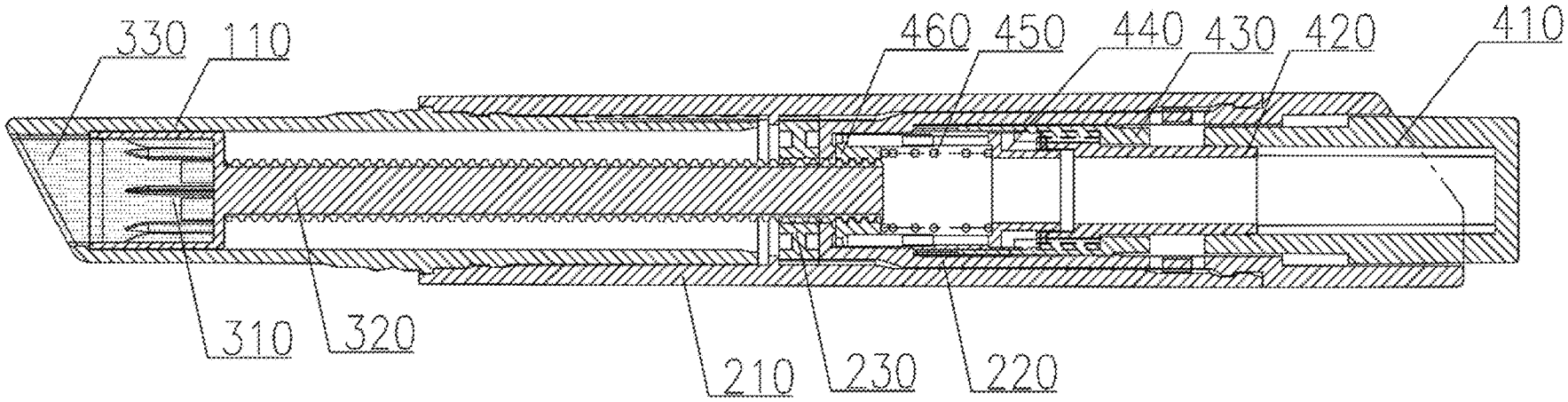
FIG. 3 is a second schematic structural view of a makeup pen according to Embodiment 1 of the present disclosure.
Figure 16:
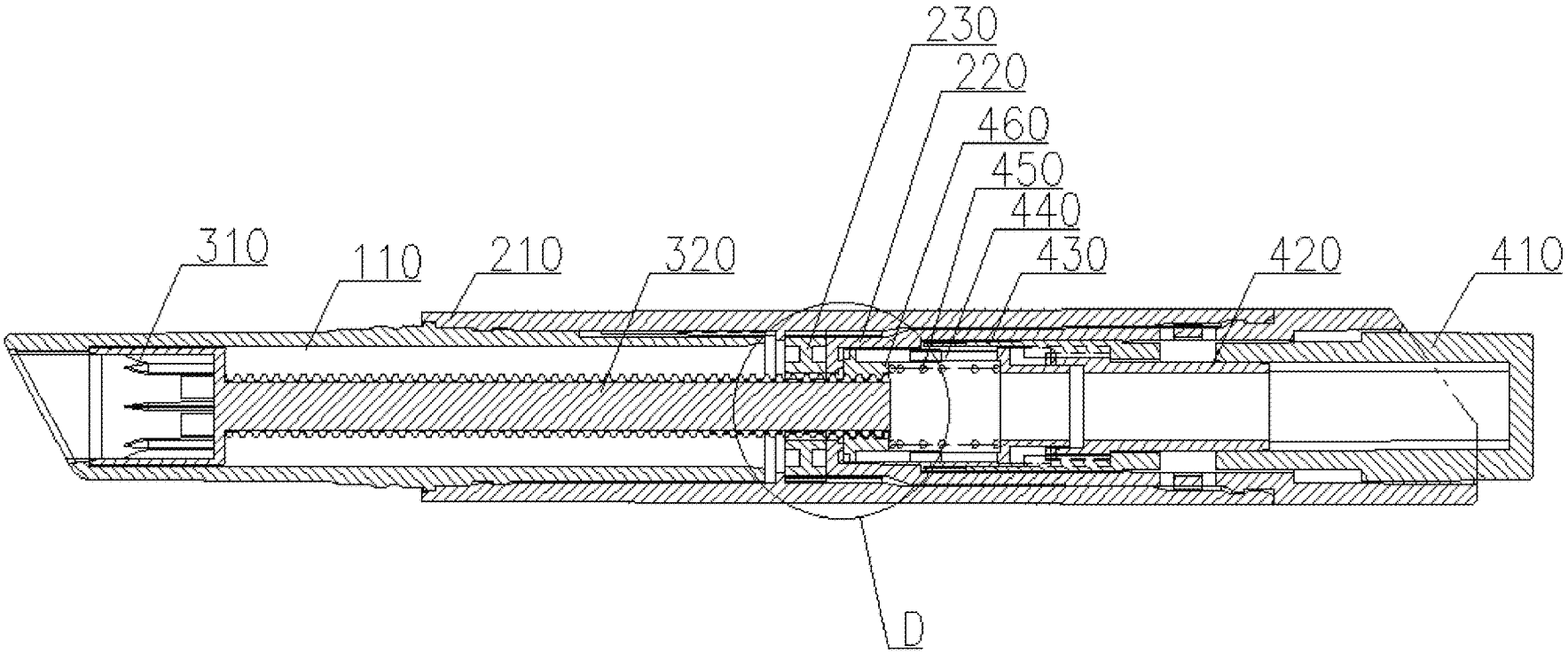
FIG. 16 is a schematic structural view before a makeup pen is filled according to Embodiment 1 of the present disclosure.

As shown in FIGS. 1-3, a front end of the sleeve 110 is an open end. The front end of the sleeve 110 is located outside the barrel 210. A rear end of the sleeve 110 is located in the barrel 210. The rear end of the sleeve 110 is close to the coupling member 220. As shown in FIG. 16, after the makeup pen is assembled completely, a first end of the discharge assembly 300 is located in the sleeve 110 and close to the open end of the sleeve 110. The cosmetic material 330 such as the lipstick is pressed into the discharge assembly 300 through the open end of the sleeve 110, thereby completing filling of the cosmetic material conveniently. Then, the coupling member 220 is rotated by the operator. Under the action of the coupling member 220, the discharge assembly 300 moves along the axial direction of the sleeve 110, such that the cosmetic material 330 retracts into the sleeve 110, until a state shown in FIG. 18, namely the cosmetic material 330 retracts into the sleeve 110 completely. At last, the cap 120 is provided, thereby completing a filling process. According to the present disclosure, after the makeup pen is assembled, since the discharge assembly is located at the front end of the sleeve, the cosmetic material is filled in the discharge assembly conveniently from the front end of the makeup pen. After the filling, by rotating the coupling member, and with connection between the coupling member and the discharge assembly, the cosmetic material retracts into the sleeve completely. Therefore, the operation is very convenient.

In response to use, under the action of the drive assembly 400, the discharge assembly 300 moves along the axial direction of the sleeve 110, such that the cosmetic material extends out of the sleeve for use. In case of an excessive discharge amount, rotating the coupling member can make the cosmetic material retract into the sleeve again. In the present disclosure, the drive assembly can be operated by a single hand to realize discharge of the makeup pen, so the present disclosure is used more conveniently, and can effectively control a discharge amount. With the coupling member, the present disclosure not only can facilitate the filling of the cosmetic material to simplify a filling process, but also can retract the excessive material into the sleeve in use to reduce pollution and waste of the material due to a misoperation. The present disclosure controls unidirectional discharge and unidirectional retraction of the cosmetic material with two systems, thereby meeting use requirements of consumers on accurate discharge and rapid retraction.

Optionally, the coupling member 220 is axially fixed and circumferentially movable in the barrel 210. The coupling member 220 in rotation can drive the drive assembly 400 to rotate synchronously, such that the drive assembly 400 drives the discharge assembly 300 to move into the sleeve 110. In a possible implementation, the structure in which the coupling member 220 is axially fixed and circumferentially movable in the barrel 210 is as follows: An outer peripheral wall of the coupling member 220 is circumferentially provided with a first snap ring. An inner peripheral wall of the barrel 210 is circumferentially provided with a second snap ring. The first snap ring is attached to the second snap ring, such that the coupling member 220 can rotate relative to the barrel 210. However, the coupling member 220 cannot move axially relative to the barrel 210. In another possible implementation, the structure in which the coupling member 220 is axially fixed and circumferentially movable in the barrel 210 is as follows: An outer peripheral wall of the coupling member 220 is circumferentially provided with a first snap ring. A clamping groove configured to clamp the first snap ring is formed in an inner peripheral wall of the barrel 210. Alternatively, the inner peripheral wall of the barrel 210 is circumferentially provided with the first snap ring. The clamping groove configured to clamp the first snap ring is formed in the outer peripheral wall of the coupling member 220. Through cooperation between the first snap ring and the clamping groove, the coupling member 220 can rotate relative to the barrel 210. However, the coupling member 220 cannot move axially relative to the barrel 210.

Optionally, the coupling member 220 is unidirectionally rotatable in the barrel 210. That is, the coupling member 220 can only rotate clockwise or counterclockwise relative to the barrel 210, such that the discharge assembly 300 can only move toward the drive assembly 400. After the cosmetic material 330 is filled, rotating the coupling member 220 makes the cosmetic material retract into the sleeve rapidly. In response to use, rotating the coupling member 220 can also make the excessive cosmetic material retract into the sleeve, thereby achieving a retractable function of the cosmetic material. However, the discharge assembly can only be controlled by the drive assembly, rather than the coupling member, thereby effectively controlling the discharge amount.

Figure 6:
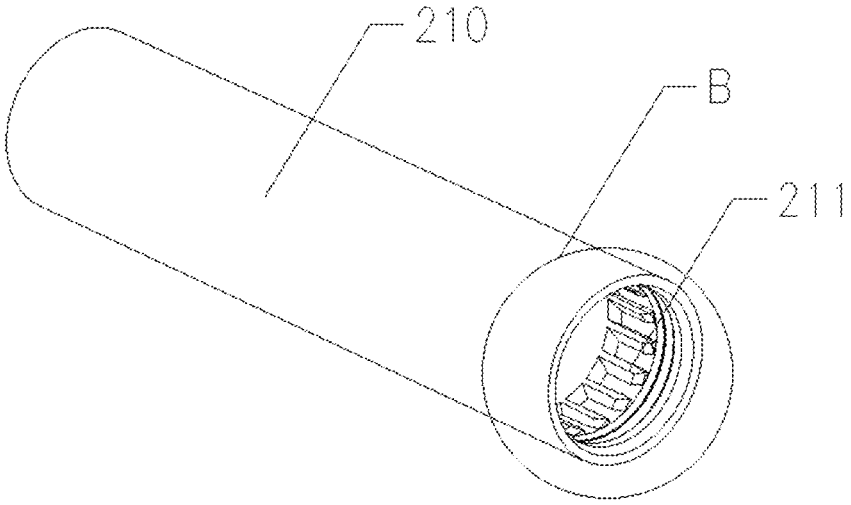
FIG. 6 is a schematic structural view of a barrel according to Embodiment 1 of the present disclosure.
Figure 7:
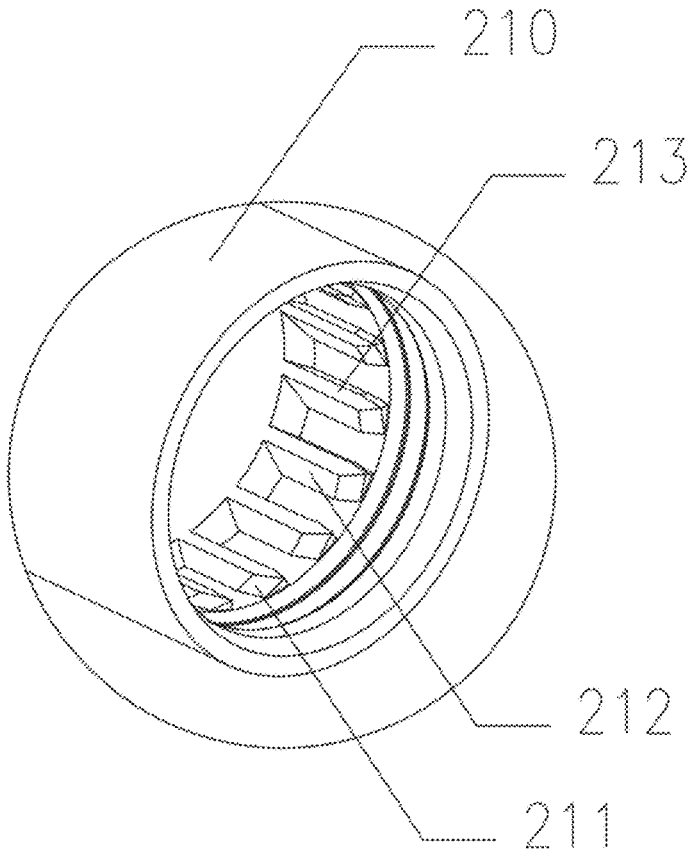
FIG. 7 is an enlarged view of B in FIG. 6.
Figure 8:
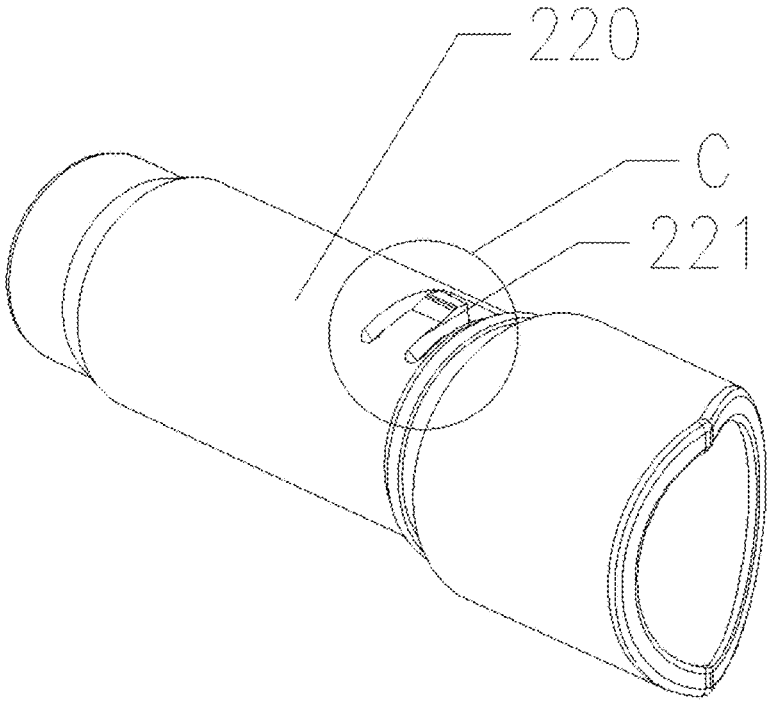
FIG. 8 is a schematic structural view of a coupling member according to Embodiment 1 of the present disclosure.
Figure 9:
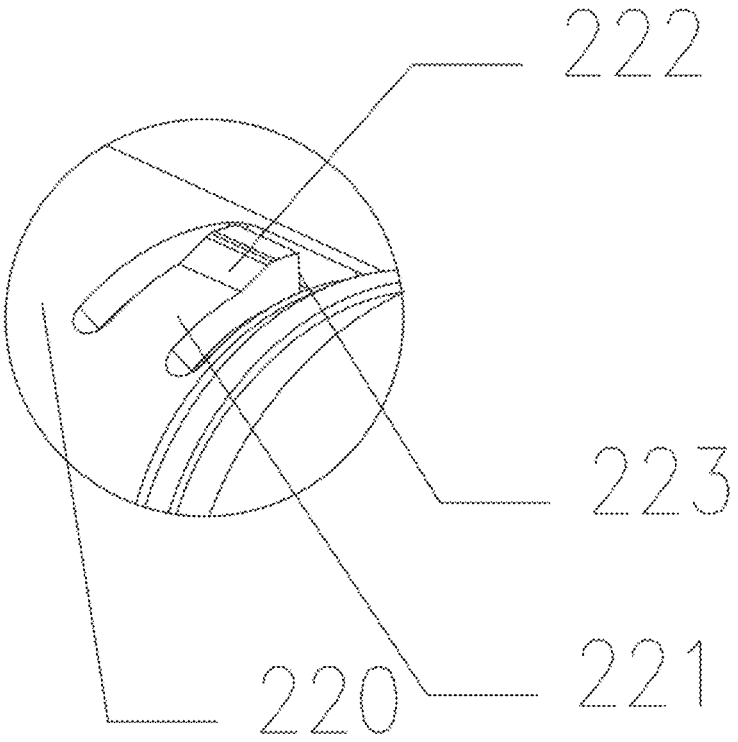
FIG. 9 is an enlarged view of C in FIG. 8.
Figure 10:
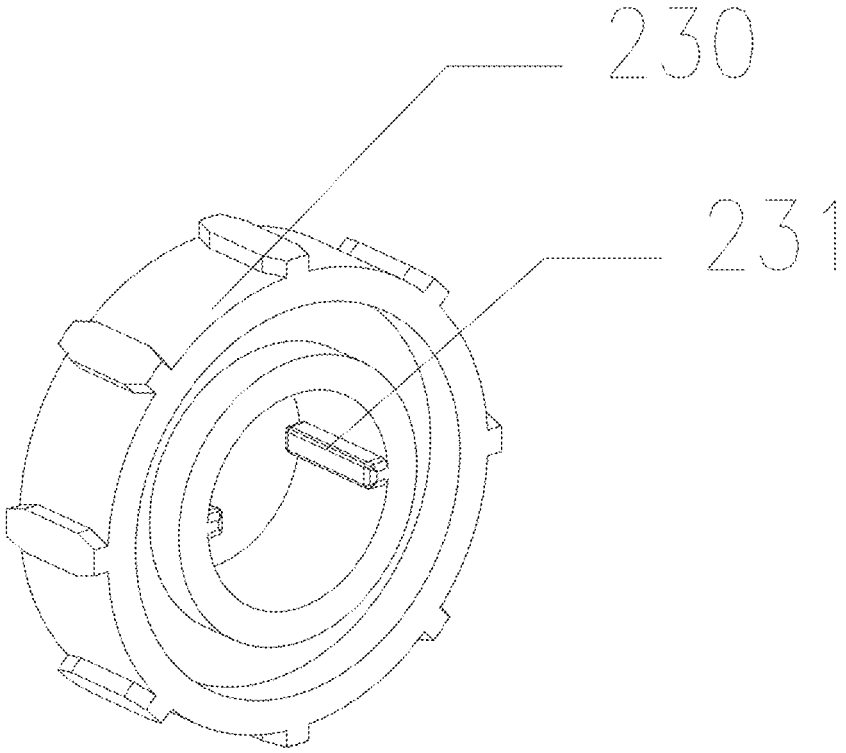
FIG. 10 is a schematic structural view of a guiding member according to Embodiment 1 of the present disclosure.

As shown in FIG. 1, the coupling member 220 protrudes from a tail portion of the barrel 210. As shown in FIG. 6 and FIG. 7, sawtooth 211 is provided on an inner sidewall of the barrel 210. First oblique plane 212 and first straight plane 213 are provided on the sawtooth 211. As shown in FIG. 8 and FIG. 9, elastic tooth 221 is provided on the coupling member 220. Second oblique plane 222 and second straight plane 223 are provided on the elastic tooth 221. The first oblique plane 212 can slide on the second oblique plane 222. The first straight plane 213 is retained at the second straight plane 223.

As shown in FIG. 8, in a possible implementation, a mounting groove is formed in the coupling member 220. The elastic tooth 221 is provided in the mounting groove. The elastic tooth 221 includes a first end fixedly connected to the coupling member 220, and a second end being a free end. Optionally, except that the first end of the elastic tooth 221 is fixedly connected to the coupling member 220, remaining portions of the elastic tooth are disconnected from the coupling member 220. Therefore, the elastic tooth 221 has a certain elasticity. As shown in FIG. 9, the second straight plane 223 is located at the second end of the elastic tooth 221, and the second oblique plane 222 is located on an outer surface of the elastic tooth 221. Optionally, two elastic teeth 221 are provided on the coupling member 220. The two elastic teeth 221 are symmetrically arranged along a central axis of the coupling member 220. A plurality of spaced sawteeth 211 are provided on the inner peripheral wall of the barrel 210. This can ensure a force balance of the coupling member 220 in rotation, and improve a user experience in operation.

After the coupling member 220 is provided on the barrel 210, the first straight plane 213 abuts against the second straight plane 223, and the first oblique plane 212 is attached to the second oblique plane 222. When the coupling member 220 is rotated clockwise, the second oblique plane 222 slides smoothly from the first oblique plane 212 of the previous sawtooth 211 to the first oblique plane 212 of the next sawtooth 211 through the elasticity of the elastic tooth 221, and the second straight plane 223 abuts against the first straight plane 213 of the next sawtooth 211 again. Since the first straight plane 213 abuts against the second straight plane 223, the coupling member 220 cannot be rotated counterclockwise. This prevents the user from manually operating the coupling member in use to extend out the cosmetic material.

In another possible implementation, a plurality of spaced elastic teeth 221 are provided on the outer peripheral wall of the coupling member 220. A plurality of spaced sawteeth 211 are provided on the inner peripheral wall of the barrel 210. Through mutual cooperation between the plurality of elastic teeth 221 and the plurality of sawteeth 211, a unidirectional rotating function of the coupling member 220 can also be achieved.

Figure 11:
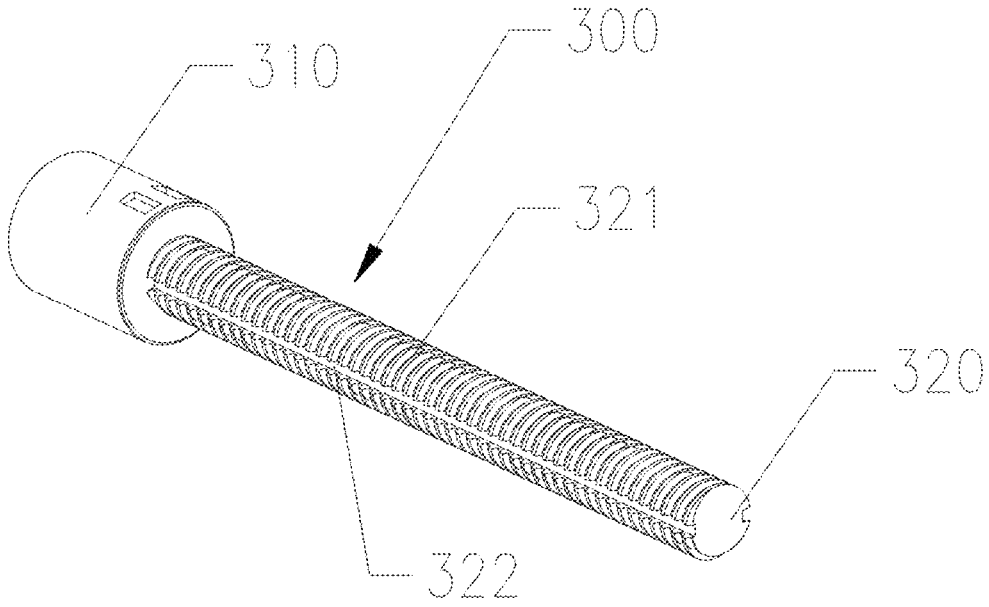
FIG. 11 is a schematic structural view of a discharge assembly according to Embodiment 1 of the present disclosure.

As shown in FIG. 1, FIG. 3 and FIG. 11, the discharge assembly 300 includes material loading cylinder 310 and threaded rod 320 fixedly connected to the material loading cylinder 310. External thread 321 is provided on an outer sidewall of the threaded rod 320. The threaded rod 320 is threadedly connected to the drive assembly 400. The drive assembly 400 is fixedly provided in the coupling member 220. When the coupling member 220 is rotated by the operator, the drive assembly 400 rotates synchronously. Since the threaded rod 320 is threadedly connected to the drive assembly 400, the threaded rod 320 and the material loading cylinder 310, namely the discharge assembly 300, move along the axial direction of the sleeve 110 under the action of the drive assembly 400, thereby retracting the cosmetic material into the sleeve 110. Likewise, in response to direct operation of the operator on the drive assembly 400 to rotate the drive assembly 400, due to the threaded connection between the threaded rod 320 and the drive assembly 400, the threaded rod 320 and the material loading cylinder 310, namely the discharge assembly 300, move along the axial direction of the sleeve 110, thereby extending the cosmetic material out of the sleeve 110.

As shown in FIGS. 1-4, the drive assembly 400 includes button 410, ratchet seat 430, and rotating member 460. The ratchet seat 430 is fixedly provided in the coupling member 220. The button 410 and the rotating member 460 are provided in the ratchet seat 430. The ratchet seat 430 in rotation can drive the rotating member 460 to rotate synchronously. The threaded rod 320 is threadedly connected to the rotating member 460. The button 410 can drive the rotating member 460 to rotate. When the coupling member 220 is rotated by the operator, the ratchet seat 430 drives the rotating member 460 to rotate synchronously. Since the threaded rod 320 is threadedly connected to the rotating member 460, the threaded rod 320 can move along the axial direction of the sleeve 110 through the rotating member 460. When the button 410 is pressed by the operator, the button 410 drives the rotating member 460 to rotate, such that the threaded rod 320 also moves along the axial direction of the sleeve 110.

In the present disclosure, through rotation of the rotating member 460, the threaded rod 320 is driven by move, thereby realizing discharge or retraction of the discharge assembly 300. A direction in which the coupling member 220 in rotation drives the rotating member 460 to rotate is opposite to a direction in which the rotating member 460 is driven by pressing the button 410 to rotate. Therefore, when the coupling member 220 is rotated, the discharge assembly 300 moves into the sleeve 110 to realize the retraction of the cosmetic material 330. When the button 410 is pressed, the discharge assembly 300 moves out of the sleeve 110 to realize the discharge of the cosmetic material 330.

In the embodiment, as shown in FIG. 11, the material loading cylinder 310 and the threaded rod 320 are an integrally formed member. The material loading cylinder 310 is configured to support the cosmetic material 330. By designing the material loading cylinder 310 and the threaded rod 320 as an integrated piece, the structure of the makeup pen is simplified.

As shown in FIGS. 1-4 and FIG. 10, the body assembly 200 further includes guiding member 230. The guiding member 230 is fixedly provided in the barrel 210. An inner sidewall of the guiding member 230 is provided with ridge 231. As shown in FIG. 11, the threaded rod 320 is provided with guiding groove 322 along an axial direction. The ridge 231 is clamped into the guiding groove 322. Optionally, two ridges 231 arranged symmetrically along a central axis are provided on the inner sidewall of the guiding member 230. Two guiding grooves 322 arranged symmetrically along a central axis are formed in the threaded rod 320. The guiding grooves 322 are formed along the whole axial direction of the threaded rod 320. After assembly, the ridge 231 is clamped into the guiding groove 322, so as to fix a moving direction of the discharge assembly 300, and improve stability of the discharge assembly in axial movement.

Figure 4:
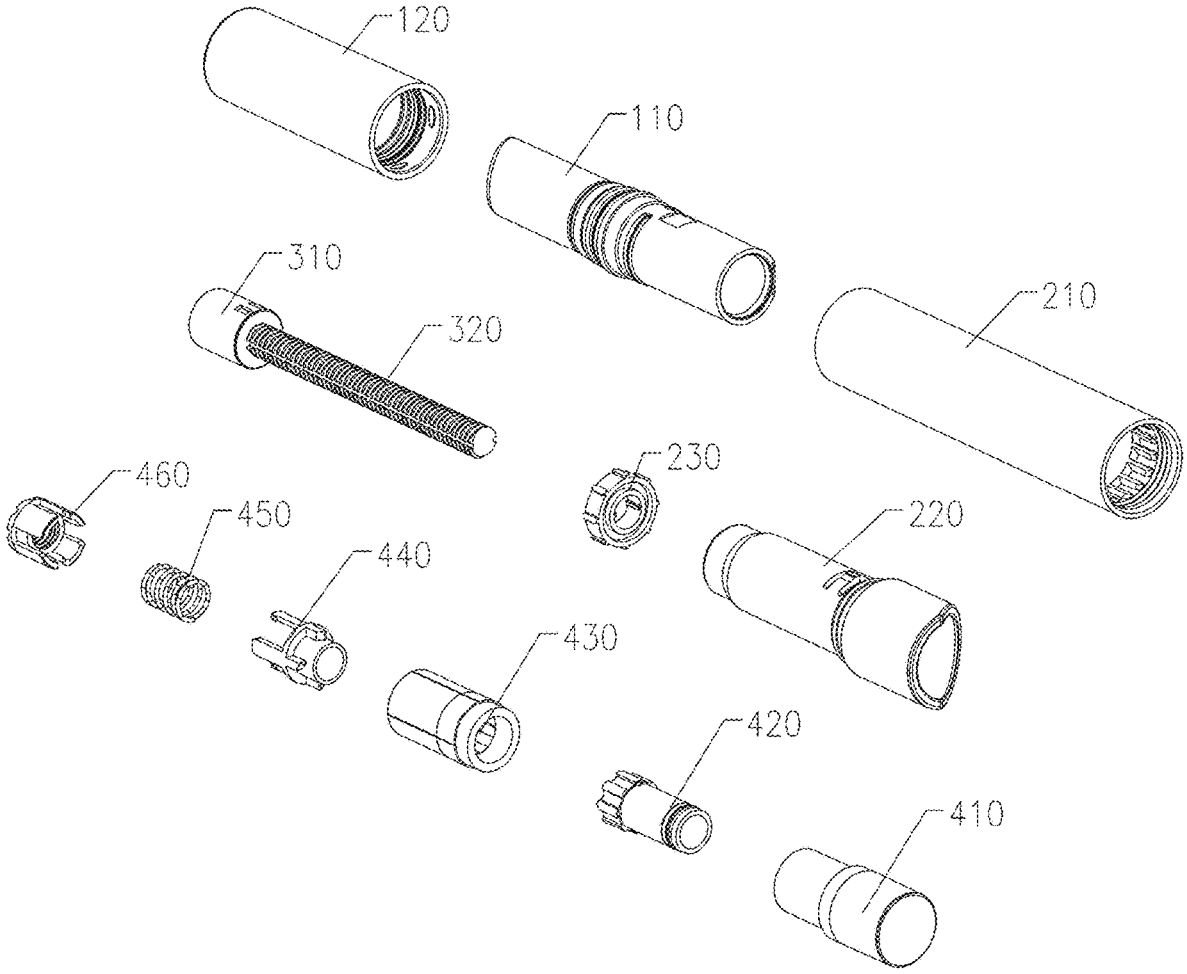
FIG. 4 is an exploded view of a makeup pen according to Embodiment 1 of the present disclosure.

In the embodiment, as shown in FIG. 4, the barrel 210 and the guiding member 230 are split structures. The guiding member 230 is clamped into the barrel 210. The guiding member 230 and the barrel 210 are respectively machined and then assembled together. This facilitates accurate control on the guiding member 230 and the barrel 210.

When the drive assembly 400 is directly pressed, the drive assembly 400 can only drive the discharge assembly 300 to move away from the drive assembly 400. As shown in FIGS. 1-4, the drive assembly 400 further includes ratchet 420, ratchet wheel 440, and elastic member 450. The ratchet 420 is fixedly provided in the button 410. The ratchet 420 and the ratchet wheel 440 are movably provided in the ratchet seat 430. Optionally, the ratchet 420 is axially movable and circumferentially fixed in the ratchet seat 430. That is, the ratchet seat 430 in rotation can drive the ratchet 420 to rotate synchronously. The ratchet 420 and the ratchet seat 430 may rotate synchronously through convex ribs that are clamped with each other.

The ratchet 420 is engaged with the ratchet wheel 440. The rotating member 460 is sleeved on the threaded rod 320 and threadedly connected to the threaded rod 320. The rotating member 460 is rotatably provided in the coupling member 220. The rotating member 460 abuts against the coupling member 220. The elastic member 450 is provided between the rotating member 460 and the ratchet wheel 440. The ratchet 420 can drive the ratchet wheel 440 to rotate. The ratchet wheel 440 can drive the rotating member 460 to rotate, such that the rotating member 460 drives the threaded rod 320 to move away from the button 410. The ratchet seat 430 is fixedly provided in the coupling member 220 by interference fit, clamping, bonding, etc. The coupling member 220 in rotation drives the ratchet seat 430 to rotate synchronously. In this way, the coupling member 220 in rotation drives the whole drive assembly 400 through the ratchet seat 430 to rotate. Since the rotating member 460 is threadedly connected to the threaded rod 320, the rotating member 460 in rotation can drive the threaded rod 320 to move into the sleeve 110. By this time, the drive assembly 400 serves as a whole to function as a big nut.

In a possible implementation, as shown in FIG. 1 and FIG. 2, the ratchet seat 430 is in interference fit with the coupling member 220, and the rotating member 460 is rotatably provided in the coupling member 220. The elastic member 450 includes a first end abutting against the rotating member 460, and a second end abutting against the ratchet wheel 440. The button 410 protrudes from the coupling member 220. In response to use, the button 410 is pressed. The button 410 drives the ratchet 420 and the ratchet wheel 440 to move synchronously toward the rotating member 460. The elastic member 450 is compressed. Meanwhile, the button 410 drives the ratchet wheel 440 through the ratchet 420 to rotate. The ratchet wheel 440 drives the rotating member 460 to rotate. The rotating member 460 drives the threaded rod 320 and the material loading cylinder 310 to move synchronously along the axial direction of the sleeve 110, thereby realizing unidirectional discharge. By pressing the button 410 once, a small amount of the cosmetic material 330 is driven by the threaded rod 320 to extend out for use. Therefore, the present disclosure facilitates control on the discharge amount, without pollution and waste of the material. After the button 410 is released, under an action of the elastic member 450, the button 410, the ratchet 420 and the ratchet wheel 440 are restored for a next pressing operation.

Figure 5:
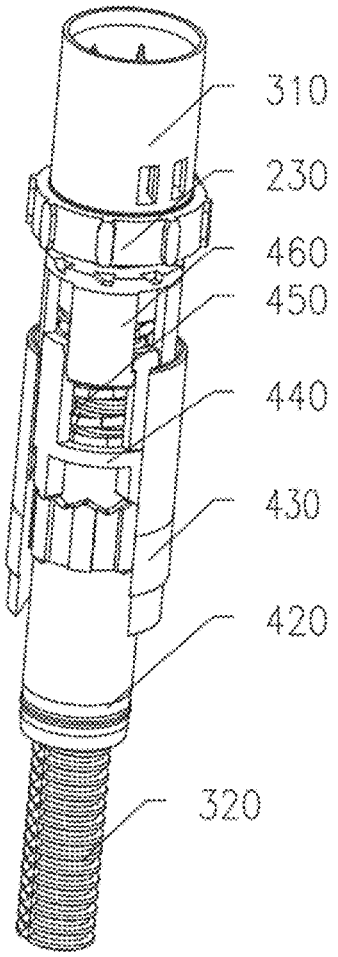
FIG. 5 is a partial schematic structural view of a makeup pen according to Embodiment 1 of the present disclosure.
Figure 12:
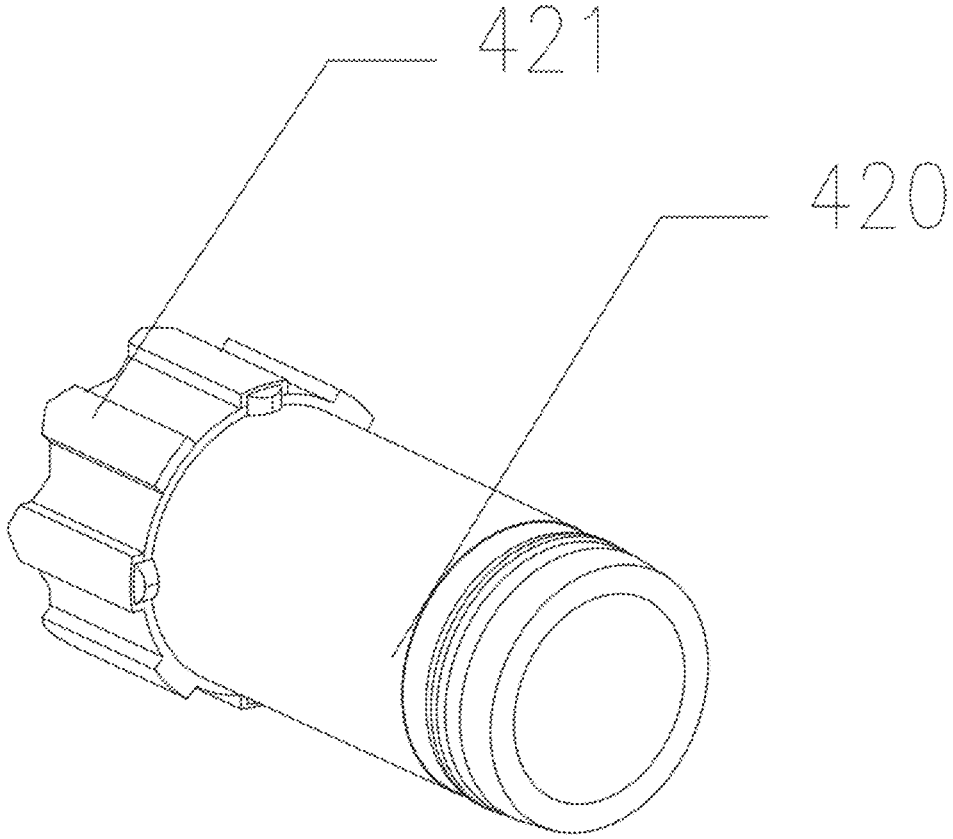
FIG. 12 is a schematic structural view of a ratchet according to Embodiment 1 of the present disclosure.
Figure 13:
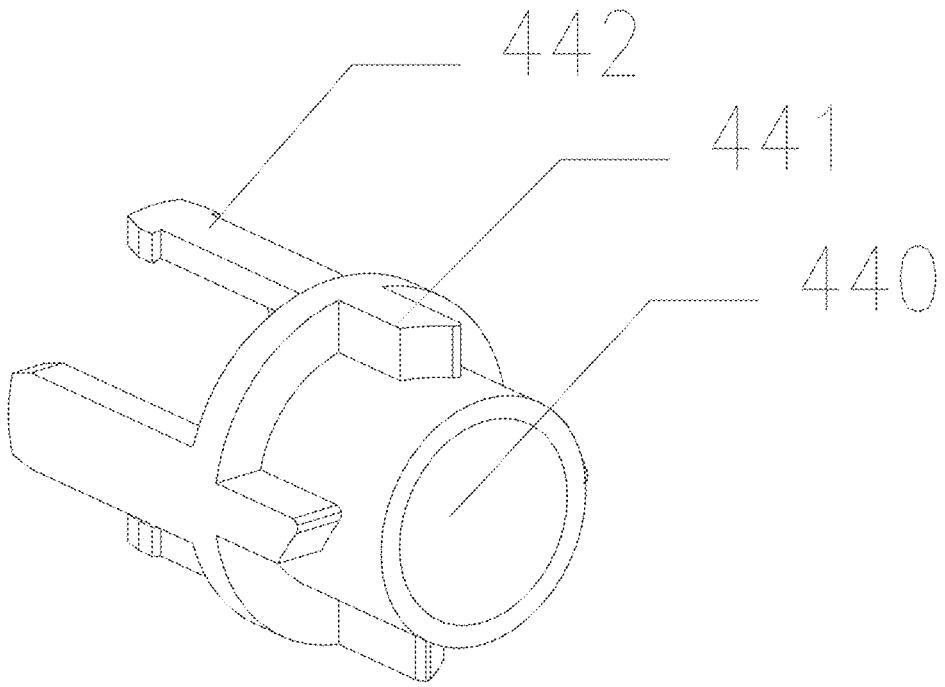
FIG. 13 is a schematic structural view of a ratchet wheel according to Embodiment 1 of the present disclosure.
Figure 14:
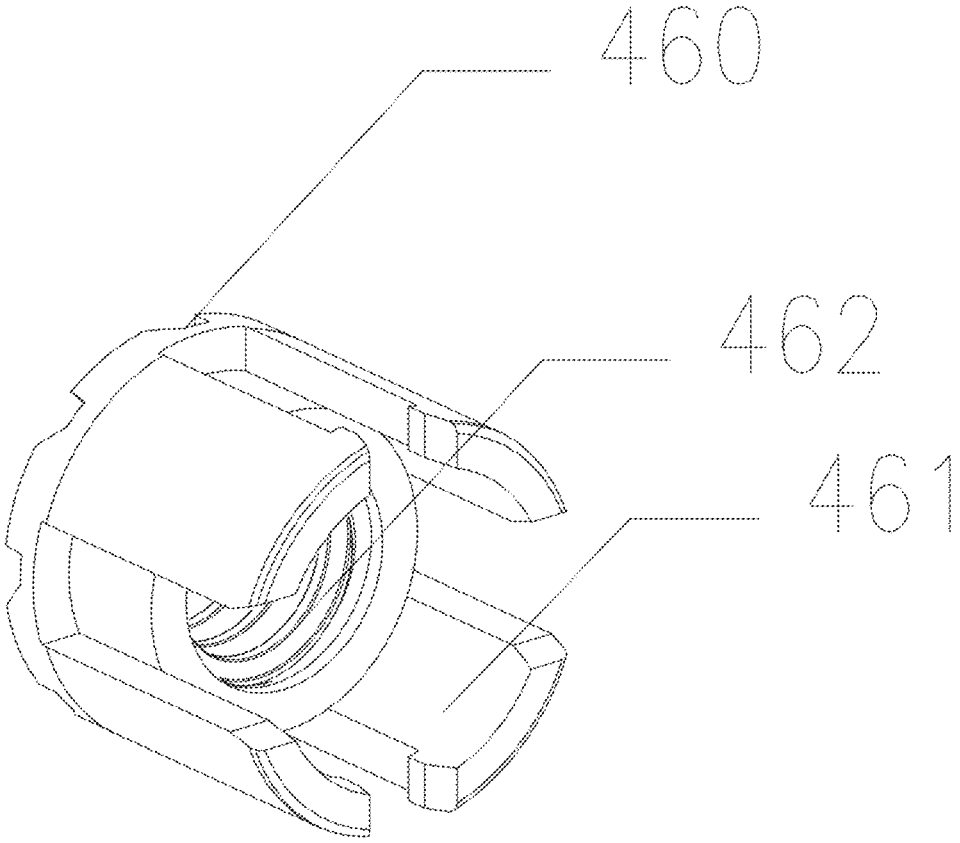
FIG. 14 is a schematic structural view of a rotating member according to Embodiment 1 of the present disclosure.

As shown in FIG. 12, first latches 421 are provided on the ratchet 420. As shown in FIG. 13, second latches 441 and first pawls 442 are provided on the ratchet wheel 440. As shown in FIG. 5 and FIG. 14, second pawls 461 are provided on the rotating member 460. Internal thread 462 is provided on an inner peripheral wall of the rotating member 460. The first latch 421 is engaged with the second latch 441. A gap is formed between two adjacent first pawls 442. The second pawls 461 are inserted into the gaps to realize synchronous rotation of the rotating member 460 and the ratchet wheel 440. When the coupling member 220 is rotated, the coupling member 220 drives the ratchet seat 430 to rotate. The ratchet seat 430 drives the ratchet 420, the ratchet wheel 440 and the rotating member 460 to rotate synchronously. That is, the whole drive assembly 400 rotates with the coupling member 220.

The rotating member 460 is sleeved on the threaded rod 320. The internal thread 462 on the rotating member 460 cooperates with the external thread 321 on the threaded rod 320. In the present disclosure, the rotating member 460 drives the threaded rod 320 to move. The rotating member 460 in movement only rotates, and does not move along the axial direction of the threaded rod 320, thereby simplifying the structure of the rotating member and the threaded rod.

Figure 15:
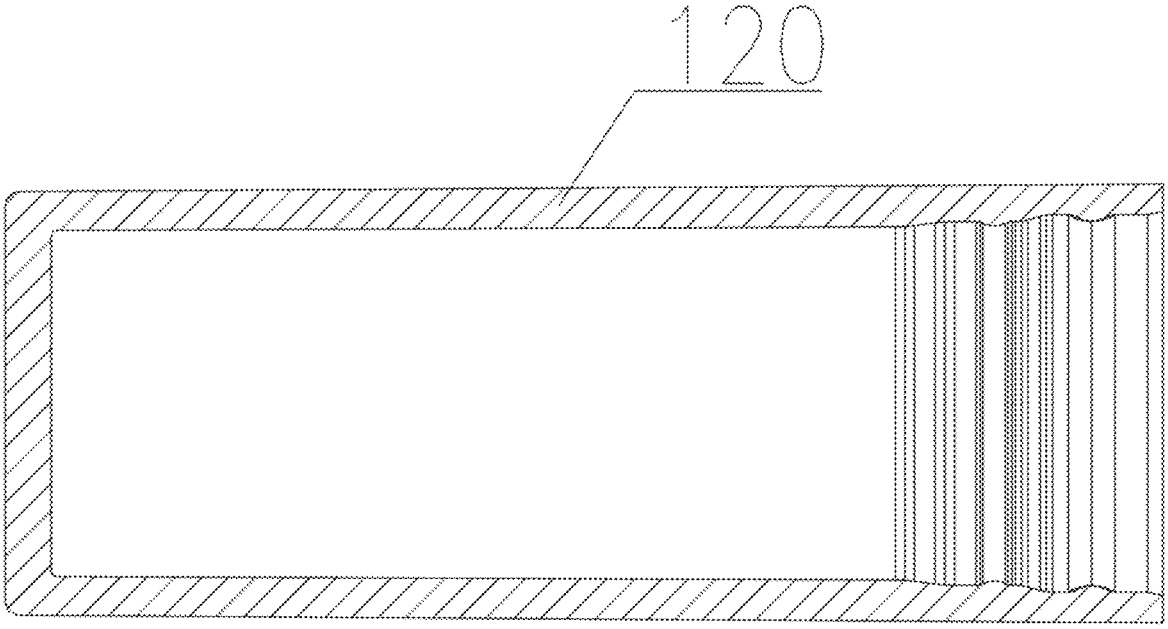
FIG. 15 is a schematic structural view of a cap according to Embodiment 1 of the present disclosure.
Figure 17:
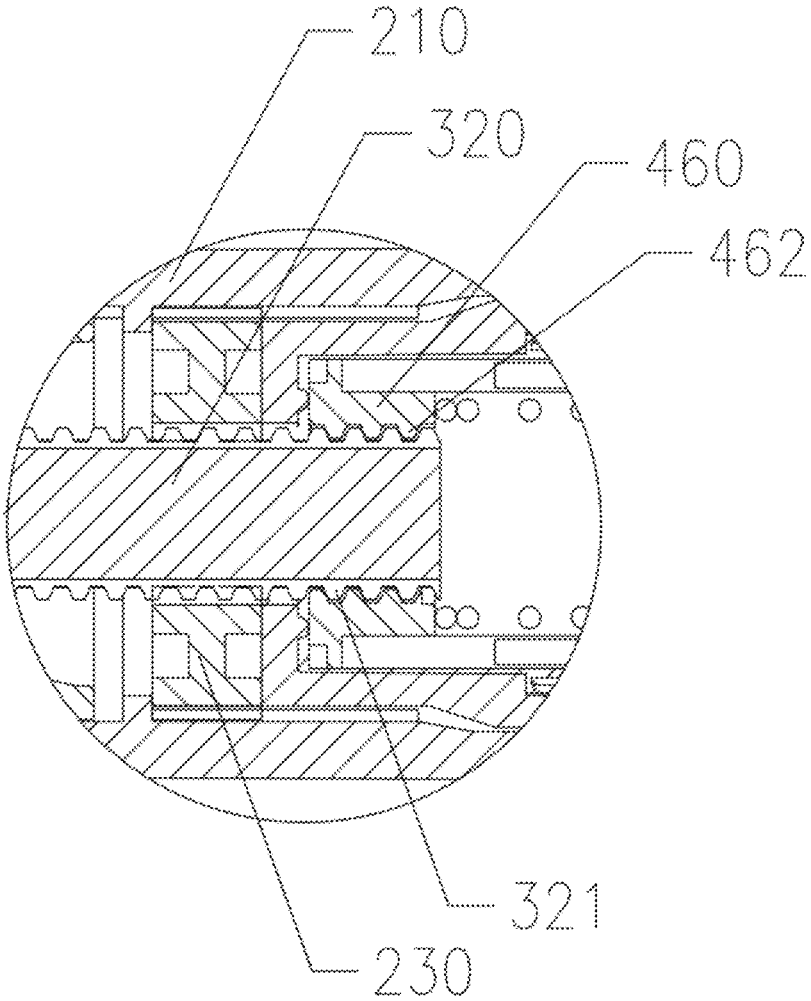
FIG. 17 is an enlarged view of D in FIG. 16.
Figure 18:
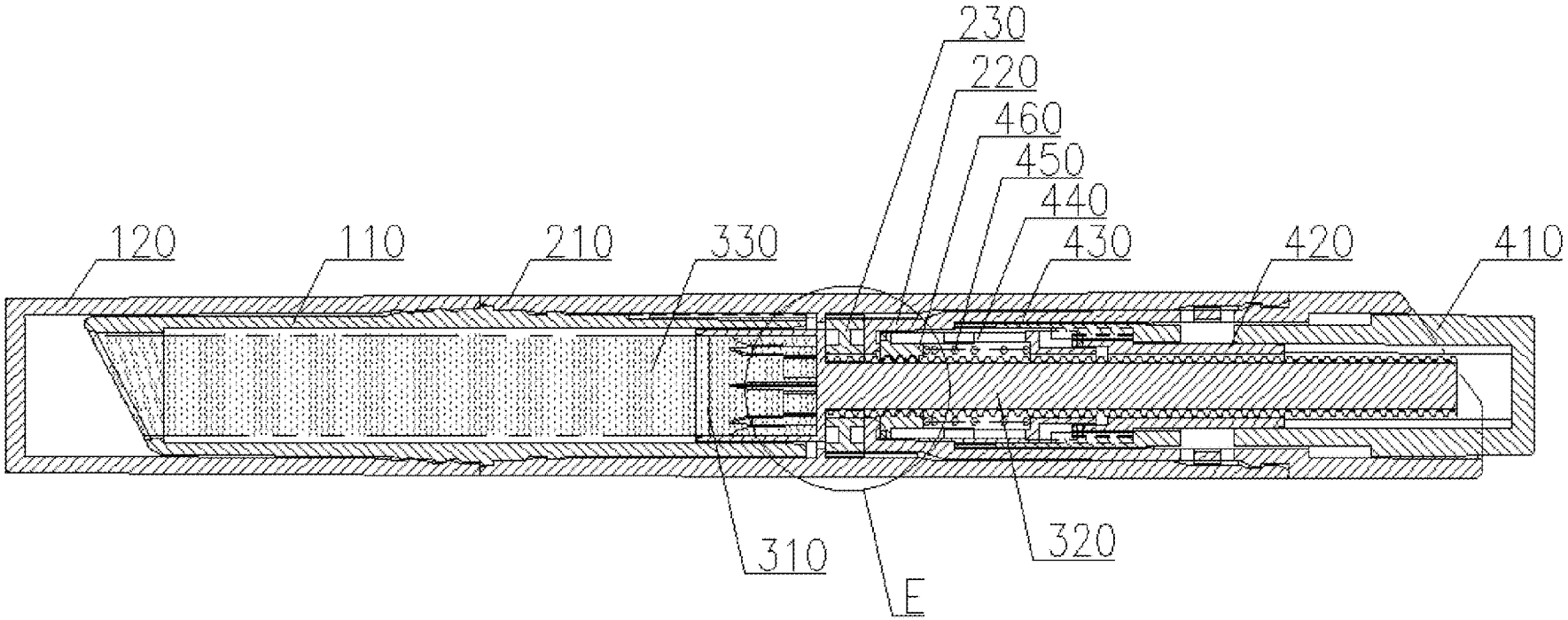
FIG. 18 is a schematic structural view after a makeup pen is filled according to Embodiment 1 of the present disclosure.
Figure 19:
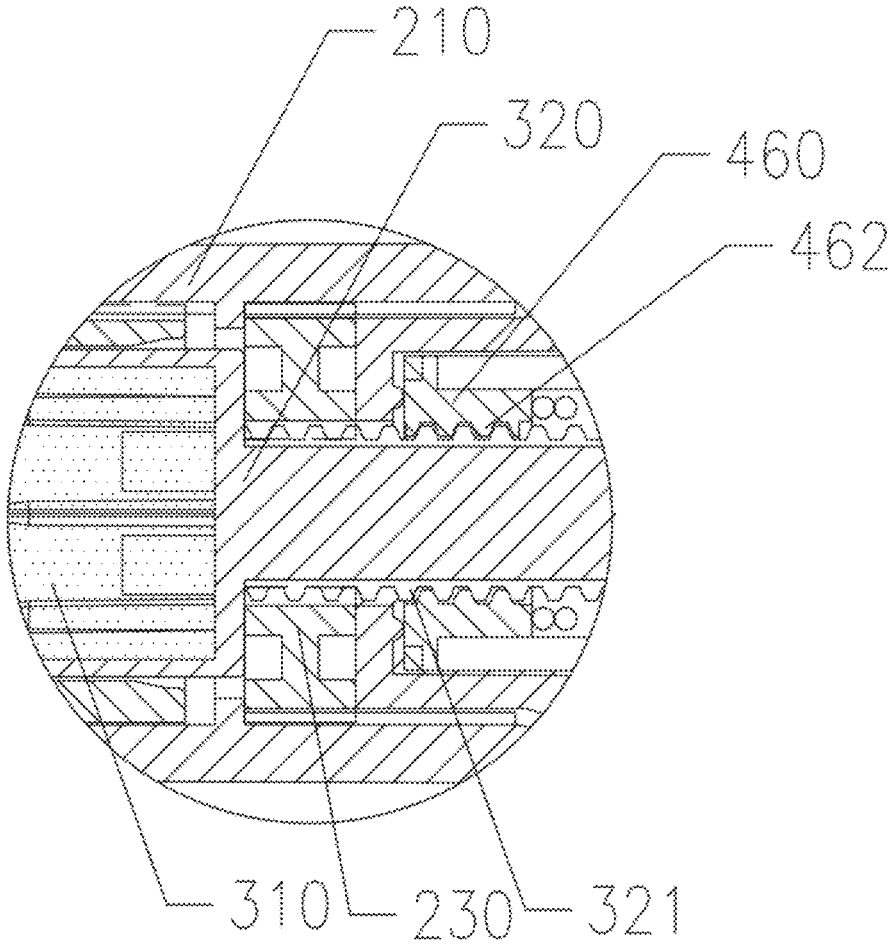
FIG. 19 is an enlarged view of E in FIG. 18.

According to the present disclosure, before the filling, as shown in FIGS. 15-17, after components of the makeup pen except the cap 120 are assembled, the ratchet seat 430 is in interference fit with the coupling member 220. The external thread 321 cooperates with the internal thread 462. The material loading cylinder 310 is close to the open end of the sleeve 110. After the cosmetic material 330 is inserted into the material loading cylinder 311, the coupling member 220 is rotated, such that the whole drive assembly 400 rotates synchronously. Since the threaded rod 320 is threadedly connected to the rotating member 460, the threaded rod 320 driven by the rotating member 460 moves into the drive assembly 400, until the cosmetic material 330 retracts into the sleeve 110 completely, and the threaded rod 320 retracts into the drive assembly 400 completely, as shown in FIG. 17 and FIG. 18. At last, the cap 120 is sleeved on the sleeve 110.

Figure 20:
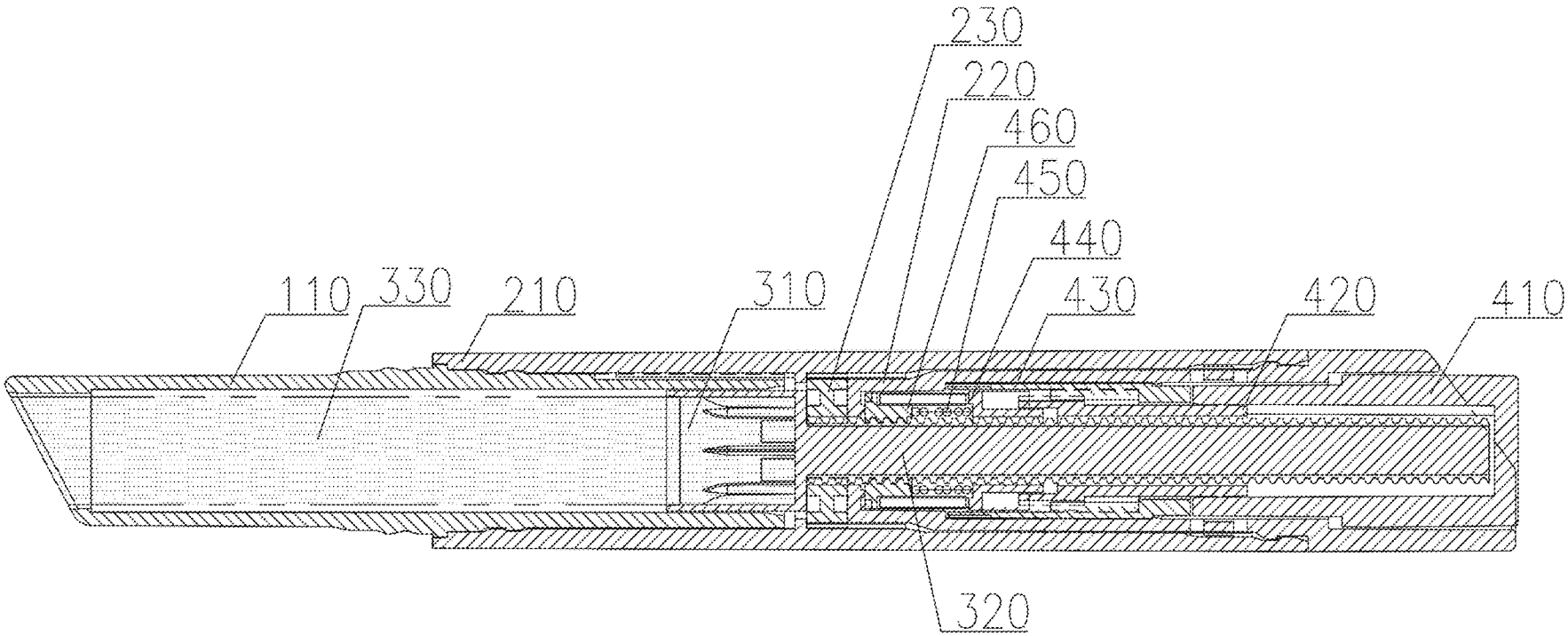
FIG. 20 is a schematic structural view after a makeup pen is pressed according to Embodiment 1 of the present disclosure.
Figure 21:
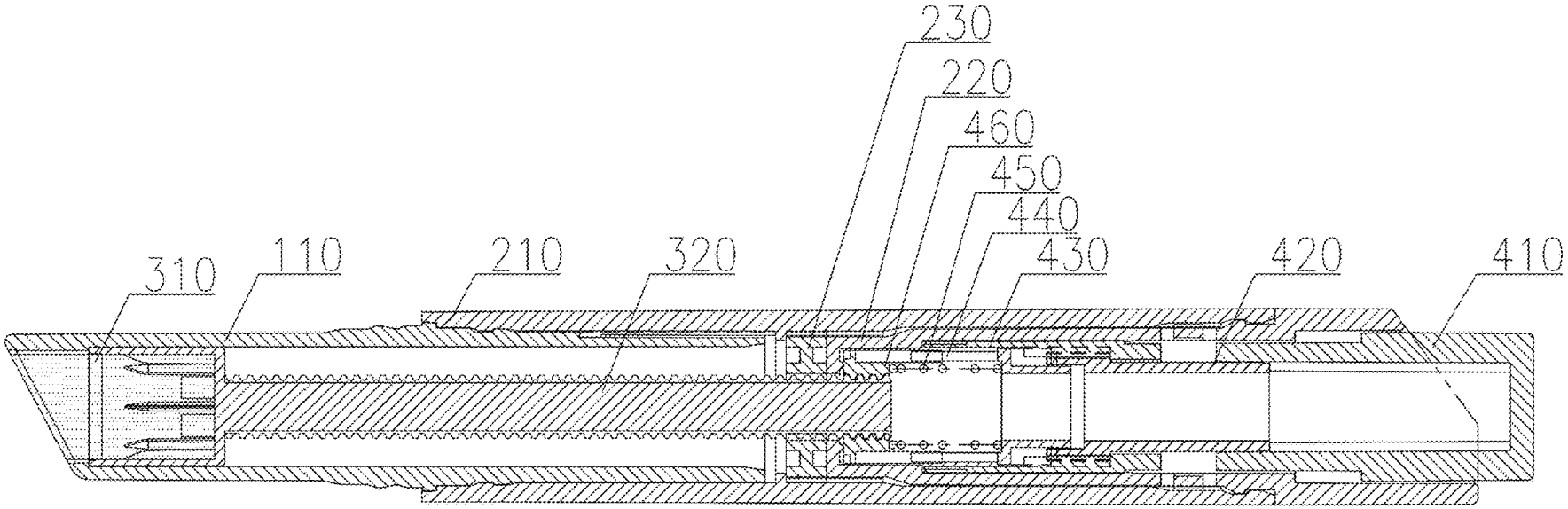
FIG. 21 is a schematic structural view after a makeup pen is used according to Embodiment 1 of the present disclosure.
Figure 22:
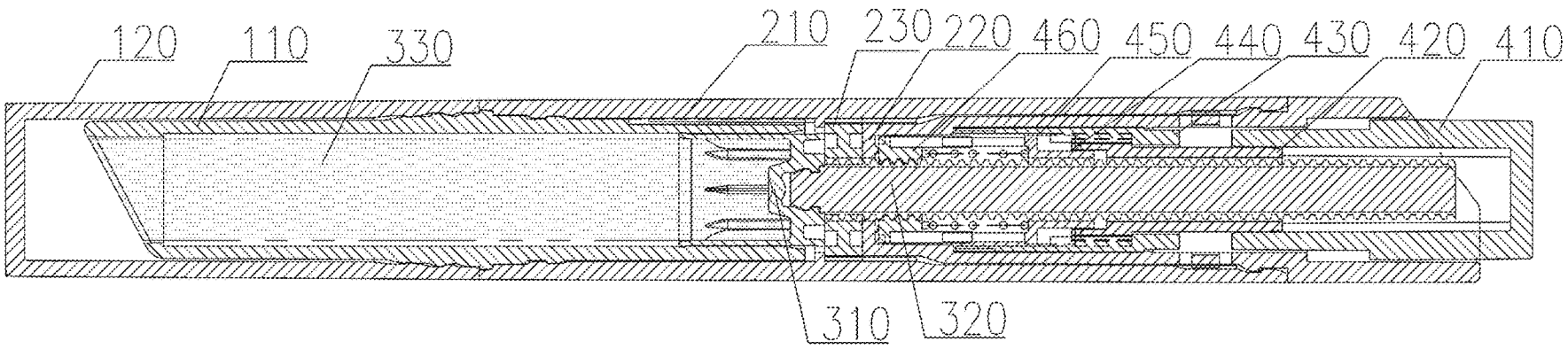
FIG. 22 is a first schematic structural view of a makeup pen according to Embodiment 2 of the present disclosure.
Figure 23:
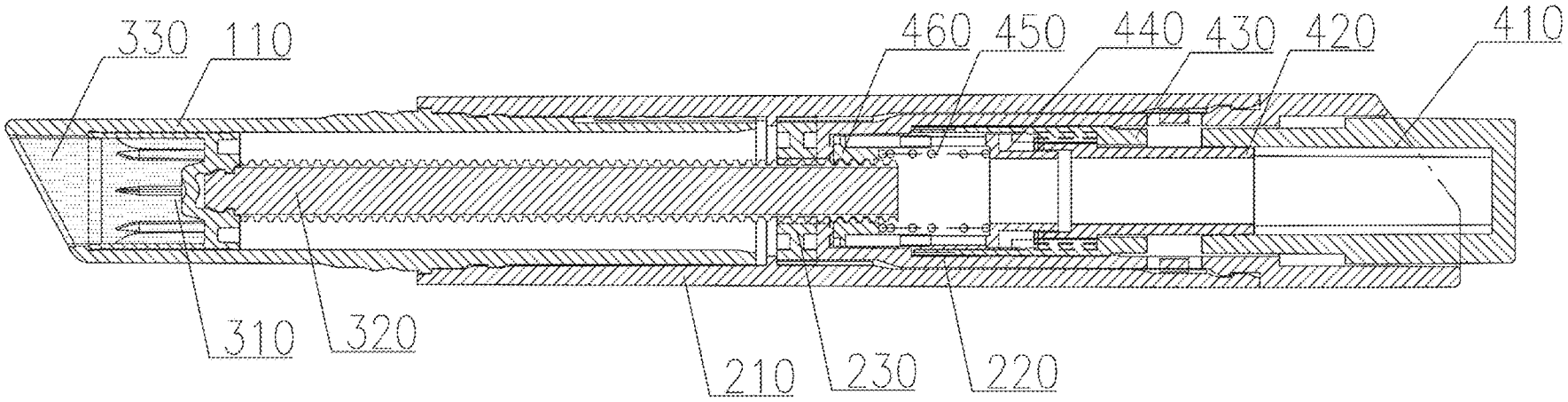
FIG. 23 is a second schematic structural view of a makeup pen according to Embodiment 2 of the present disclosure.
Figure 24:
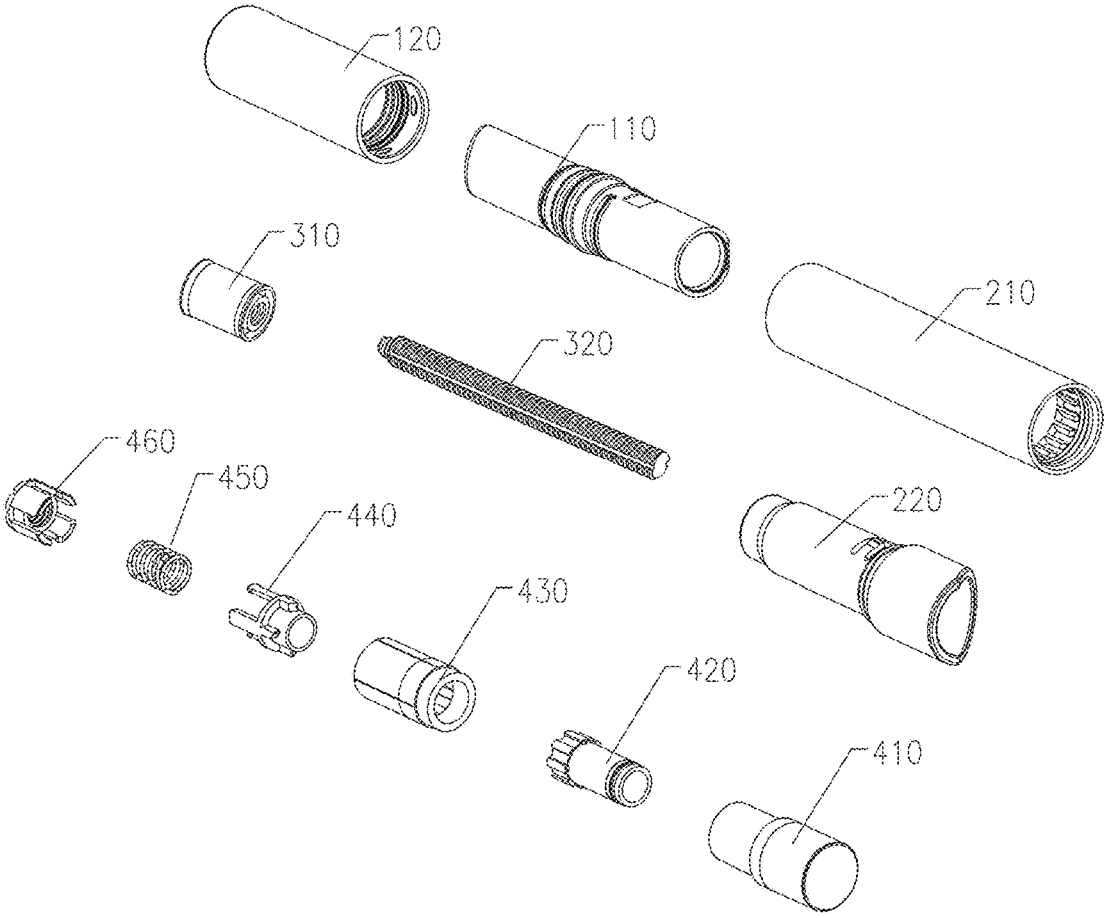
FIG. 24 is an exploded view of a makeup pen according to Embodiment 2 of the present disclosure.

In response to use, the button 410 on the tail portion of the makeup pen is pressed. The button 410 drives the ratchet 420 and the ratchet wheel 440 to move synchronously toward the rotating member 460. The elastic member 450 is compressed. The button 410 drives the ratchet wheel 440 through the ratchet 420 to rotate. The ratchet wheel 440 drives the rotating member 460 to rotate. Since the external thread 321 cooperates with the internal thread 462, the rotating member 460 drives the threaded rod 320 and the material loading cylinder 310 to move synchronously along the axial direction of the sleeve 110, thereby realizing unidirectional discharge. By pressing the button 410 once, a small amount of the cosmetic material 330 is driven by the threaded rod 320 to extend out for use. After the button 410 is released, under an action of the elastic member 450, the button 410, the ratchet 420 and the ratchet wheel 440 are restored for a next pressing operation. FIG. 20 illustrates a state in which the button 410 is pressed. FIG. 21 illustrates a state in which the cosmetic material is used up, and the loading member 310 and the threaded rod 320 move synchronously into the sleeve 110.

Figure 25:
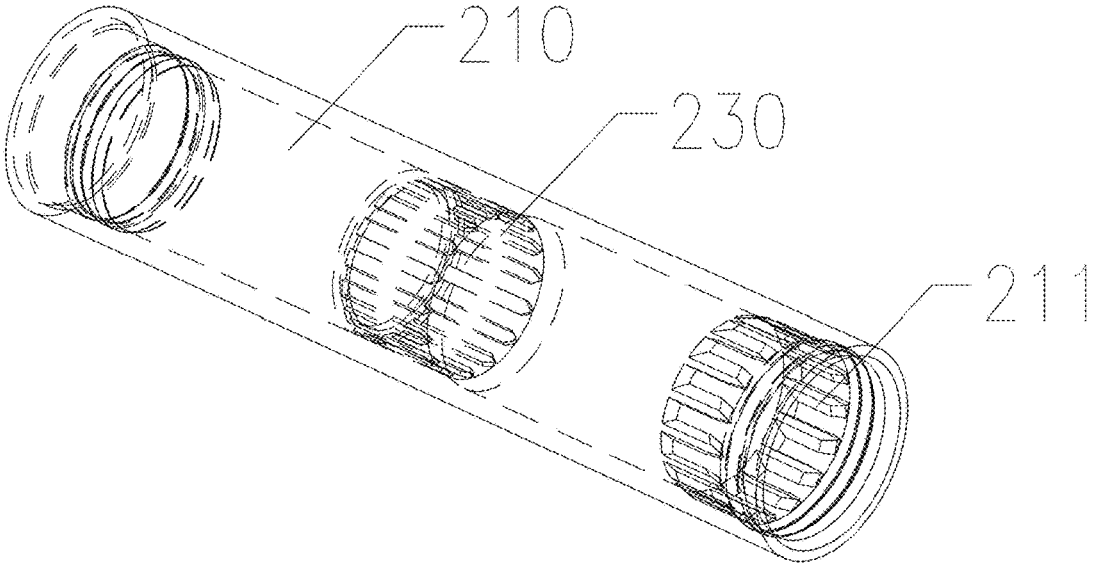
FIG. 25 is a perspective view of a barrel according to Embodiment 2 of the present disclosure.

Embodiment 2: As shown in FIGS. 22-25, the material loading cylinder 310 and the threaded rod 320 are split structures. The threaded rod 320 is clamped and fixed on the material loading cylinder 310. The material loading cylinder 310 and the threaded rod 320 are respectively machined and then assembled together to form the discharge assembly 300. This facilitates accurate control on the guiding member 310 and the barrel 320. As shown in FIG. 25, the guiding member 230 is directly formed in the barrel 210. By designing the guiding member 230 and the barrel 210 as an integrated piece, the structure of the makeup pen is simplified.

It should be noted that a person of ordinary skill in the art can further make variations and improvements without departing from the conception of the present disclosure. These variations and improvements all fall within the protection scope of the present disclosure. Therefore, the protection scope of the present disclosure shall be subject to the appended claims.

What is claimed is:

1. A retractable press makeup pen, comprising a nib assembly, a body assembly, a discharge assembly, and a drive assembly, wherein the nib assembly comprises a sleeve;

the body assembly comprises a barrel and a coupling member rotatably provided in the barrel;

the sleeve is fixedly provided in the barrel;

the drive assembly is provided in the coupling member;

the discharge assembly is provided in the sleeve;

the discharge assembly is connected to the drive assembly;

the coupling member in rotation is configured for driving the discharge assembly to move into the sleeve; and the drive assembly is configured for driving the discharge assembly to move out of the sleeve;

wherein the coupling member is unidirectionally rotatable in the barrel;

wherein a sawtooth is provided on an inner sidewall of the barrel; a first oblique plane and a first straight plane are provided on the sawtooth; an elastic tooth is provided on the coupling member; a second oblique plane and a second straight plane are provided on the elastic tooth; the first oblique plane is configured for sliding on the second oblique plane; and the first straight plane is retained at the second straight plane; wherein the coupling member is axially fixed and circumferentially movable in the barrel; and the coupling member in rotation is configured for driving the drive assembly to rotate synchronously, wherein the drive assembly drives the discharge assembly to move into the sleeve; wherein the discharge assembly comprises a material loading cylinder and a threaded rod fixedly connected to the material loading cylinder; an external thread is provided on an outer sidewall of the threaded rod; the threaded rod is threadedly connected to the drive assembly; and the drive assembly is fixedly provided in the coupling member; and wherein the drive assembly comprises a button, a ratchet seat, and a rotating member; the ratchet seat is fixedly provided in the coupling member; the button and the rotating member are provided in the ratchet seat; the ratchet seat in rotation is configured for driving the rotating member to rotate synchronously; the threaded rod is threadedly connected to the rotating member; and the button is configured for driving the rotating member to rotate.

2. The retractable press makeup pen according to claim 1, wherein a mounting groove is formed in the coupling member; the elastic tooth is provided in the mounting groove; the elastic tooth comprises a first end fixedly connected to the coupling member, and a second end being a free end; the second straight plane is located at the second end of the elastic tooth; and the second oblique plane is located on an outer surface of the elastic tooth.

3. The retractable press makeup pen according to claim 2, wherein the discharge assembly comprises a material loading cylinder and a threaded rod fixedly connected to the material loading cylinder; an external thread is provided on an outer sidewall of the threaded rod; the threaded rod is threadedly connected to the drive assembly; and the drive assembly is fixedly provided in the coupling member.

4. The retractable press makeup pen according to claim 3, wherein the drive assembly comprises a button, a ratchet seat, and a rotating member; the ratchet seat is fixedly provided in the coupling member; the button and the rotating member are provided in the ratchet seat; the ratchet seat in rotation is configured for driving the rotating member to rotate synchronously; the threaded rod is threadedly connected to the rotating member; and the button is configured for driving the rotating member to rotate.

5. The retractable press makeup pen according to claim 1, wherein the discharge assembly comprises a material loading cylinder and a threaded rod fixedly connected to the material loading cylinder; an external thread is provided on an outer sidewall of the threaded rod; the threaded rod is threadedly connected to the drive assembly; and the drive assembly is fixedly provided in the coupling member.

6. The retractable press makeup pen according to claim 5, wherein the material loading cylinder and the threaded rod are an integrally formed member; or the material loading cylinder and the threaded rod are split structures, and the threaded rod is clamped and fixed on the material loading cylinder.

7. A retractable press makeup pen, comprising a nib assembly, a body assembly, a discharge assembly, and a drive assembly, wherein the nib assembly comprises a sleeve;

the body assembly comprises a barrel and a coupling member rotatably provided in the barrel;

the sleeve is fixedly provided in the barrel;

the drive assembly is provided in the coupling member;

the discharge assembly is provided in the sleeve;

the discharge assembly is connected to the drive assembly;

the coupling member in rotation is configured for driving the discharge assembly to move into the sleeve; and the drive assembly is configured for driving the discharge assembly to move out of the sleeve;

wherein the discharge assembly comprises a material loading cylinder and a threaded rod fixedly connected to the material loading cylinder; an external thread is provided on an outer sidewall of the threaded rod; the threaded rod is threadedly connected to the drive assembly; and the drive assembly is fixedly provided in the coupling member;

wherein the drive assembly comprises a button, a ratchet seat, and a rotating member; the ratchet seat is fixedly provided in the coupling member; the button and the rotating member are provided in the ratchet seat; the ratchet seat in rotation is configured for driving the rotating member to rotate synchronously; the threaded rod is threadedly connected to the rotating member; and the button is configured for driving the rotating member to rotate.

8. The retractable press makeup pen according to claim 7, wherein the drive assembly further comprises a ratchet, a ratchet wheel, and an elastic member;

the ratchet is fixedly provided in the button;

the ratchet and the ratchet wheel are movably provided in the ratchet seat;

the ratchet is engaged with the ratchet wheel;

the rotating member is sleeved on the threaded rod and threadedly connected to the threaded rod;

the rotating member is rotatably provided in the coupling member;

the rotating member abuts against the coupling member; the elastic member is provided between the rotating member and the ratchet wheel;

the ratchet is configured for driving the ratchet wheel to rotate; and the ratchet wheel is configured for driving the rotating member to rotate, wherein the rotating member drives the threaded rod to move away from the button.

9. The retractable press makeup pen according to claim 8, wherein first latches are provided on the ratchet; second latches and first pawls are provided on the ratchet wheel; second pawls are provided on the rotating member; an internal thread is provided on an inner peripheral wall of the rotating member; the first latch is engaged with the second latch; a gap is formed between two adjacent first pawls; and the second pawls are inserted into the gaps to realize synchronous rotation of the rotating member and the ratchet wheel.

10. A retractable press makeup pen, comprising a nib assembly, a body assembly, a discharge assembly, and a drive assembly, wherein the nib assembly comprises a sleeve;

the body assembly comprises a barrel and a coupling member rotatably provided in the barrel;

the sleeve is fixedly provided in the barrel;

the drive assembly is provided in the coupling member;

the discharge assembly is provided in the sleeve;

the discharge assembly is connected to the drive assembly;

the coupling member in rotation is configured for driving the discharge assembly to move into the sleeve; and the drive assembly is configured for driving the discharge assembly to move out of the sleeve;

wherein the discharge assembly comprises a material loading cylinder and a threaded rod fixedly connected to the material loading cylinder; an external thread is provided on an outer sidewall of the threaded rod; the threaded rod is threadedly connected to the drive assembly; and the drive assembly is fixedly provided in the coupling member;

wherein the body assembly further comprises a guiding member; the guiding member is fixedly provided in the barrel; an inner sidewall of the guiding member is provided with a ridge; the threaded rod is provided with a guiding groove along an axial direction; and the ridge is clamped into the guiding groove.

11. The retractable press makeup pen according to claim 10, wherein the guiding member is directly formed in the barrel; or the barrel and the guiding member are split structures, and the guiding member is clamped into the barrel.

* * * * *